US005203040A

United States Patent [19]

Hochschild, III

[11] Patent Number: 5,203,040

[45] Date of Patent: Apr. 20, 1993

[54] SOFT-SIDED FLOTATION MATTRESS FRAME

[76] Inventor: Arthur A. Hochschild, III, 7274 Lampson Ave., Garden Grove, Calif. 92641

[21] Appl. No.: 962,328

[22] Filed: Oct. 16, 1992

[51] Int. Cl.[5] ..... A47C 27/08

[52] U.S. Cl. ..... 5/400; 5/451; 5/460; 5/474; 5/917

[58] Field of Search ..... 5/400, 401, 451, 452, 5/474, 917, 460

[56] References Cited

U.S. PATENT DOCUMENTS

| | | | |
|---|---|---|---|
| 4,057,862 | 11/1977 | LaBianco | 5/451 |
| 4,107,799 | 8/1978 | Lambert | 5/451 X |
| 4,145,781 | 3/1979 | Autrey et al. | 5/917 X |
| 4,187,566 | 2/1980 | Peterson | 5/451 |
| 4,237,564 | 12/1980 | Zeltzer | 5/451 X |
| 4,508,397 | 3/1985 | Fogel et al. | 5/451 |
| 4,637,082 | 1/1987 | Moore et al. | 5/451 X |
| 4,771,491 | 9/1988 | Fogel et al. | 5/451 X |
| 4,879,775 | 11/1989 | Keefer | 5/451 X |

*Primary Examiner*—Michael F. Trettel
*Attorney, Agent, or Firm*—Georges A. Maxwell

[57] ABSTRACT

A soft-sided waterbed frame structure comprising a flat horizontal, rectilinear flotation mattress-supporting platform with a top surface and elongate side and end edge portions; elongate anchor plates fixed to said edge portions; elongate wall sections of soft resilient material overlying said edge portions and projecting upwardly therefrom; elongate interengageable male and female coupling parts on the anchor plates and the wall sections and slidably engageable with each other to releasably secure the wall sections to the platform; the platform and wall sections define upwardly opening frame structure to receive and support the bottom and sides of a soft resilient slack-filled water flotation mattress structure.

18 Claims, 3 Drawing Sheets

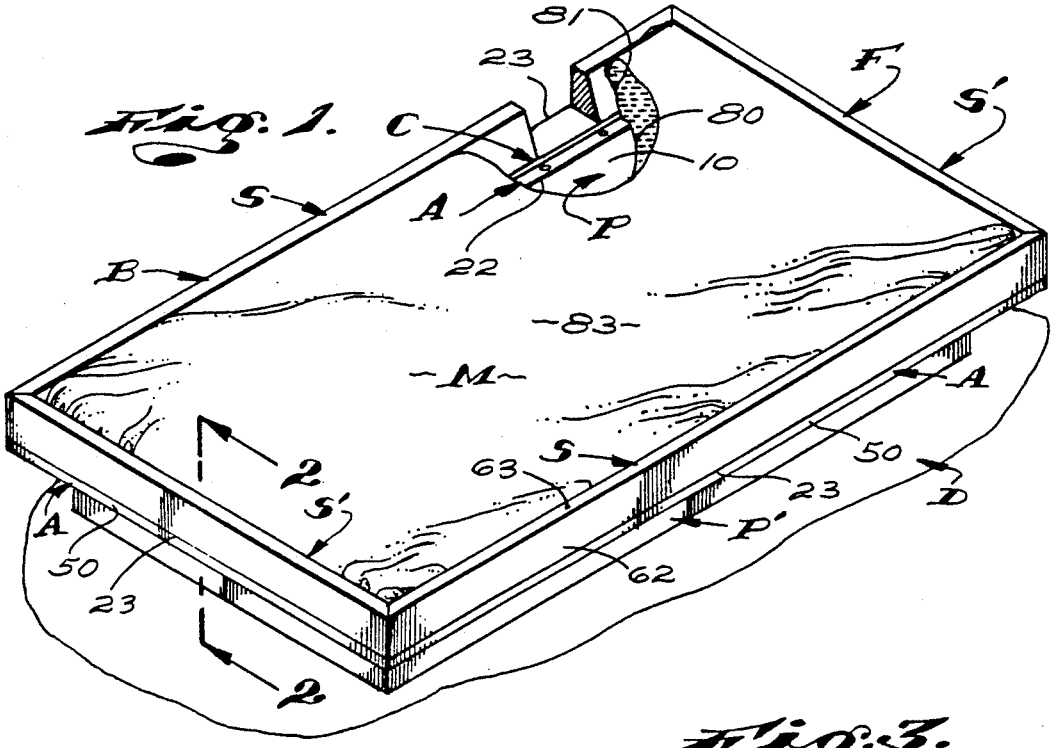
Fig. 1.
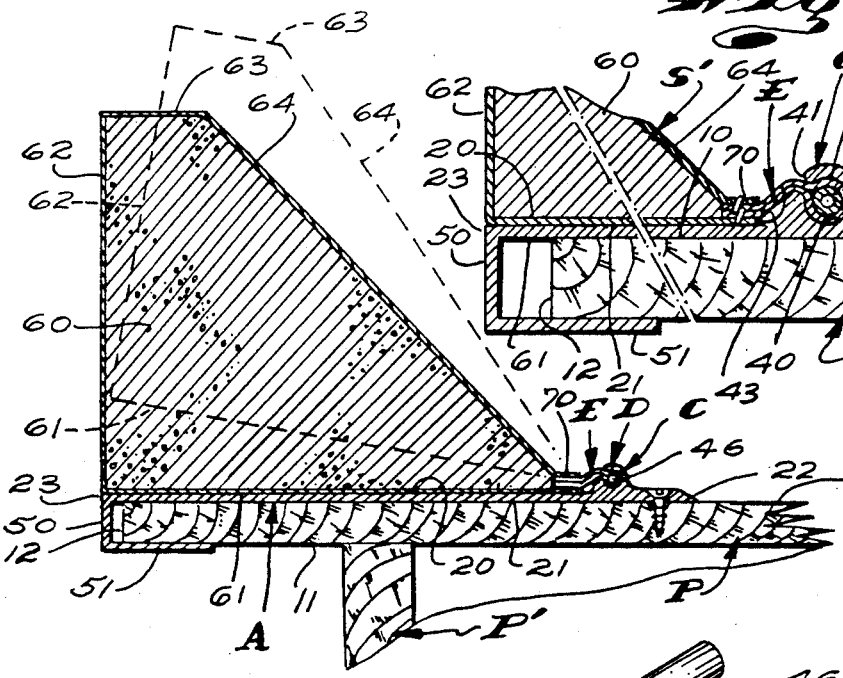
Fig. 2.
Fig. 3.
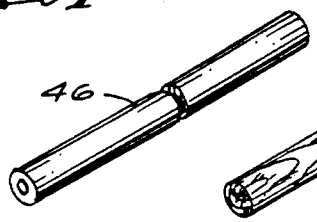
Fig. 4.
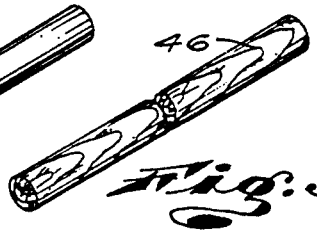
Fig. 5.

SOFT-SIDED FLOTATION MATTRESS FRAME

BACKGROUND OF THE INVENTION

Waterbeds are, as a general rule, characterized by water-filled bladders formed of flexible water impervious sheet material atop which persons using the beds lie to be buoyantly supported thereby. The bladders are most commonly supported atop platforms made of plywood or the like to position the top planes or surfaces of the bladders in predetermined, desired, space relationship above the surface of the deck or floor on which the beds are supported.

Some waterbeds are provided with one large bladder of rectangular planned configuration while others include a plurality of elongate tubular bladders arranged in side-by-side relationship to establish an assembly of bladders of desired rectilinear planned configuration.

The bladders of such beds are partially or slack-filled with water so that the upwardly disposed top or body engaging and supporting surfaces of the bladders will readily conform to the shape and contour of the bodies of the users and enable the users to be buoyantly supported by the water therein.

Due to the highly flexible or "fluid" nature of water-filled bladders for such beds, it is necessary that the platforms upon which the bladders are supported be provided with upwardly extending frames about their perimeters to support and retain the bladders against horizontal or outward displacement and to control and assure desired and proper functioning of the whole of the bed structures.

In many waterbeds, the retaining frames include side and end boards that are fixed to and project upwardly from the outer perimeters of the platforms to occur outward of and support the outer perimeters of the bladders and to prevent undesired outward displacement thereof. This kind of platform and retaining frame assembly is commonly referred to as a "hard-sided bed frame." In the case of waterbeds with hard-sided bed frames, the standard operating depth or vertical extent of the bladders is approximately 9" and the boards of the frames are made to project approximately 9" above their related platforms where they present hard edges about the upper outer perimeters of the bladders which are often extremely awkward, difficult and discomforting obstructions that the users of the beds must cope with when entering, using and departing from the beds. Further, as is well known in the art, the unitized platforms and side and end walls of hard-sided waterbed frames are large, heavy, and difficult or troublesome to store, transport and install.

In an effort to overcome and avoid the numerous shortcomings and undesirable characteristics of hard-sided waterbed frames, the prior art provides what are referred to as "soft-sided bed frames" that include flat horizontal platforms of plywood or the like with retaining frames of soft, flexible and resilient foam plastic that project up from the perimeters of the platform to occur about and support the outer perimeters of the bladders, in essentially the same way that hard-sided waterbed frames do. The soft plastic frames of soft-sided waterbed frames are such that they yield and compress under the weight of the users of the beds as the users enter and leave the beds and are sufficiently soft and yielding so that they cause little or no discomfort to the users, when the users' bodies come into contact therewith.

A serious shortcoming that characterizes some soft-sided bed frames is the fact that the foam sides and end walls of those frames must be of substantial thickness (from the inside to the outside surfaces thereof). That is, rather than being 1½" to 2" thick, they must, for example, be 8" to 10" thick; thereby decreasing the inside longitudinal and lateral dimensions of the frame structures as much as 16" to 20" less than a hard-sided bed frame structure (assuming that the outside dimensions of the bed are let to remain standard).

Other soft-sided waterbed frame structures provided by the prior art overcome the above-noted shortcomings by tapering the inside surfaces of the side and end walls of the frames outwardly and upwardly so that the strength and capacity of the frames to effectively support the sides and ends of their related bladders diminish upwardly as the hydrostatic forces of the water (within the bladders) acting upon them diminishes. The above practice, together with using slightly smaller bladders, or by filling the bladders with slightly less water, enables the art to provide soft-sided bed frames having standard outside dimensions without adverse reduction of the dimensions of the top, flotation wall of the bladder.

Another serious shortcoming that is found to exist in soft-sided waterbed frames is the fact that the side and end walls of the frames must be fixed or secured to their related platforms at the time of manufacturer and establish unitary bed frame structures that are large and difficult to store, ship, install and the like.

Yet another serious shortcoming that is found to exist in soft-sided waterbed frames of the character referred to above resides in the fact that the foam plastic side and end walls, that are unitary parts cut from large blocks or slabs of foam plastic, must be contained and retained in soft flexible jackets or envelopes of sheet plastic or fabric that are utilized to fasten or secure those frame parts to their related platforms, to provide an attractive surface and to protect the foam plastic parts from wear, and the like. Unfortunately, as the above-noted structures are used and the foam plastic walls are repeated compressed and let to expand both vertically and horizontally, the foam plastic walls are slowly and progressively caused to stretch, warp and turn or twist within their envelopes and to become so displaced and distorted that the frames can no longer function as they should and become so unattractive that the frames must be disposed of and replaced with new frames. While the foregoing tendency for the foam plastic parts to distort and become displaced, as noted above, can be minimized by several different means and by exercising special care when producing the frames, the use of those means and that care that must be exercised is costly of time and/or materials and notably adds to the cost of the bed frame structures.

Some in the prior art provide soft-sided waterbed frame structures of the general character referred to above wherein the longitudinally extending lower side edges of the envelopes about the foam plastic walls are fastened to the platforms to enable the users of those frames, when making up their beds, to tuck the edges of their sheets and/or blankets between the bottoms of the walls and their related edge portions of the top surfaces of the platforms. This enables the users to make up their beds in a neat, attractive and most acceptable fashion. The principal shortcoming of the above-noted innovation in soft-sided waterbed frames resides in the fact that the outer perimeter portions of the platforms must be suitably dressed up with costly upholstery or the like. Further, due to the limited securement of the walls of such frames to their related platforms, the assemblies become almost impossible to store, transport and install, since the walls, in whole or in part, tend to pivot and swing about relative to the platforms whenever the assemblies are tipped and/or turned, as when being stored, transported and installed. The use of tape, straps, wrappings and the like to hold the parts in position prior to being put to use have proven to be so inefficient, costly and/or inconvenient, that many retailers and installers of waterbeds would prefer not to handle them.

PRIOR ART

In 1975 or 1976, a soft-sided waterbed frame with removable side and end rails was made available in the marketplace. In that bed frame structure, the platform was provided with upwardly projecting wooden cleats or retaining walls about its outer perimeter and the soft rails were provided with rigid, wooden, retaining boards along their inner lower edges that stopped against the inner sides of the retaining walls. It is understood that, due to the tendency of the retaining boards to elevate and then ride over the retaining walls, that bed frame proved to be of questionable utility. Applicant knows of no other prior art soft-sided waterbed frames with removable side and end rails.

OBJECTS AND FEATURES OF THE INVENTION

It is an object of the invention to provide an improved soft-sided frame structure for a flotation mattress that includes a flat horizontal rectilinear waterbed bladder-supporting platform having longitudinally extending opposite side edge portions and laterally extending opposite end edge portions, pairs of soft resilient bladder-supporting side and end wall sections or units, anchor plates secured to the side and end edge portions of the platform and interengageable coupling parts on the wall units and anchor plates releasably securing the wall units to the platform.

It is another object of the invention to provide a soft-sided frame of the general character referred to above which is such that the wall units and anchor plates can be arranged in parallel adjacent relationship and neatly packaged for easy and economical transporting and storing of those parts as they move through commerce from their site of manufacture to their site of use.

It is object and feature of the invention to provide a soft-sided frame of the character referred to above wherein each anchor plate is an elongate strip-like part nailed, screw-fastened and/or cemented to a related edge portion of a related platform and wherein the coupling parts include male parts with elongate channels with narrow longitudinally extending access slots in each anchor plate and female parts with elongate webs with enlarged splines secured to each wall unit and slidably engaged in the slots and in the channels of related female part.

Another object and feature of the invention is to provide a soft-sided frame of the general character referred to above wherein the adjacent ends of related side and end wall units are right angularly related to each other and wherein the related ends of the units are formed to establish neat sturdy corners.

It is yet another object and feature of the invention to provide a soft-sided frame structure of the general character referred to above wherein the spline of the male coupling part related to at least one wall unit is flexible to allow for flexure of that wall unit relative to an end of a previously coupled wall unit and to thereby facilitate slidably engaging and disengaging the web and spline of said one wall unit into and out of the slot and channel of a related anchor plate during assembly or disassembly of the frame structure.

An object of the invention is to provide a soft-sided frame of the character referred to above which is such that the parts thereof can be easily and conveniently packaged, transported and stored in disassembled relationship and such that the parts can be easily and quickly assembled at the site at which the bed frame is to be used.

Another object and feature of the invention is to provide a soft-sided frame of the general character referred to above wherein the wall units include soft resilient foam plastic cores with horizontal top and bottom surfaces, vertical outside surfaces, upwardly and outwardly inclined inside surfaces and flat end surfaces, and an outer envelope of flexible sheet material engaged about and enclosing the core; each anchor part has top and bottom surfaces and, inside and outside edges and is similar in planned configuration with the bottom surface of a related wall unit; each anchor plate overlies and is secured to an outer edge portion of a related platform; the female coupling part on each anchor plate extends longitudinally of the inside edge thereof; and, the web of the male coupling part on each wall unit is secured to the envelope thereof to extend longitudinally of the lower inside corner edge of the unit.

Finally, it is an object and feature of the invention to provide a soft-sided frame of the general character referred to above wherein the anchor plates with their female coupling parts are elongate extruded plastic units and are formed with downwardly and thence inwardly projecting walls that extend longitudinally of their outside edges and that embrace and shield the outside edge of their related edge portions of the platform.

The foregoing and other objects and features of the invention will be fully understood from the following detailed description of the invention throughout which description reference is made to the accompanying drawings.

DESCRIPTION OF THE DRAWINGS

FIG. 1 is an isometric view of a waterbed including a soft-sided frame structure embodying the invention;

FIG. 2 is an enlarged detailed sectional view taken substantially as indicated by Line 2—2 on FIG. 1;

FIG. 3 is an enlarged view of structure shown in FIG. 2;

FIGS. 4 and 5 are isometric views of splines;

DETAILED DESCRIPTION OF THE INVENTION

Figure 6:
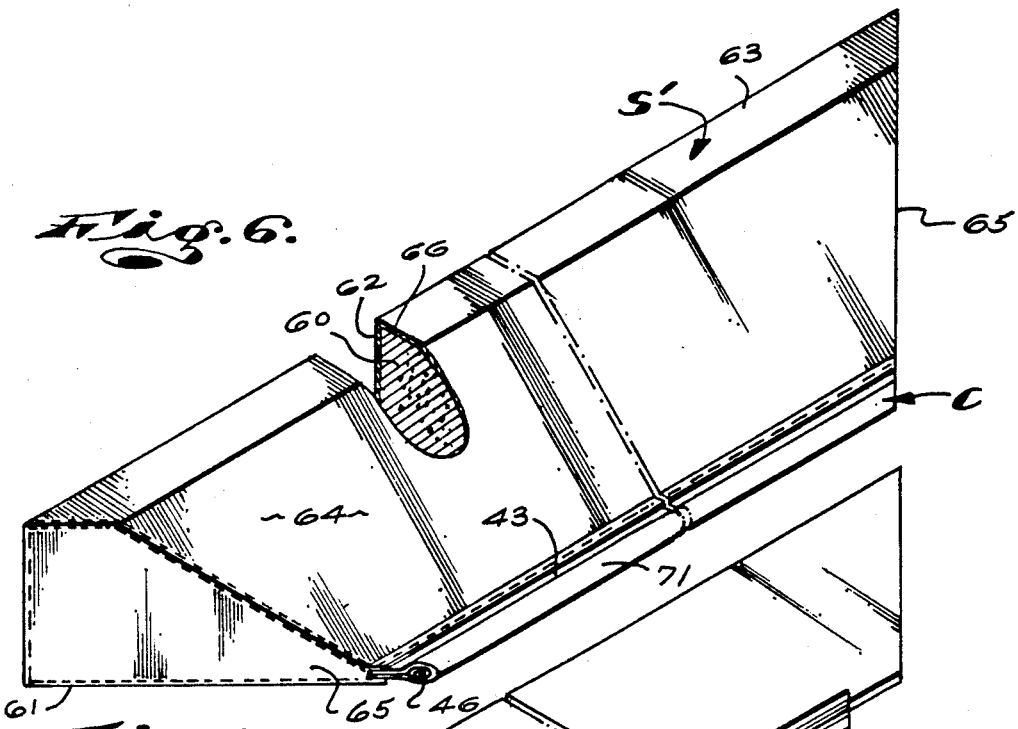
FIG. 6 is an isometric view of a wall unit.
Figure 7:
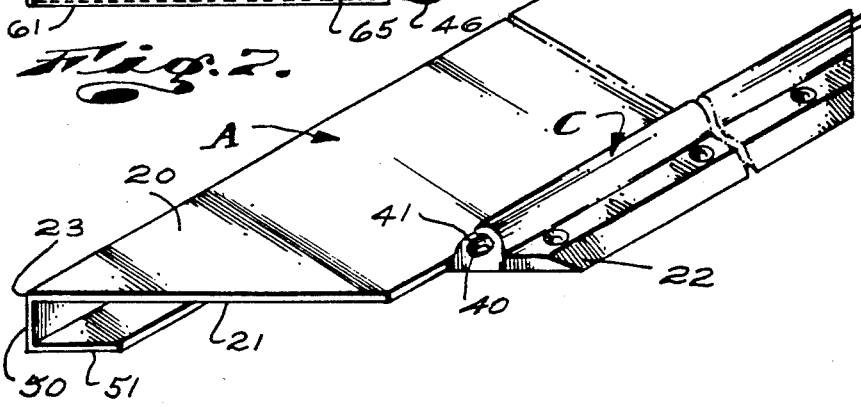
FIG. 7 is an isometric view of an anchor plate.

FIG. 1 of the drawings illustrates a typical waterbed structure B with a soft-sided waterbed frame F embodying the present invention.

The bed B includes a flat horizontal platform P made of plywood or the like. The platform P is rectangular in planned configuration and has flat top and bottom surfaces 10 and 11, parallel oppositely disposed, longitudinally extending outer side edges or edge portions (not shown) and parallel oppositely disposed, laterally extending outside edges or edge portions 12.

The platform P is substantially the same in longitudinal and lateral extent as is the bed structure of which it is a part.

In accordance with common practices, the platform P is shown supported by a pedestal P' engaged between the bottom surface 11 and a supporting floor or deck D. The outwardly disposed sides of the pedestal are spaced inward from the outside edges or edge portions of the platform P to provide toe room.

The bed structure B next includes the soft-sided rectangular retaining frame F mounted atop and extending about the outer perimeter portion of the platform P.

The frame F projects upwardly from the platform and is provided to engage and support the outer walls of a water-filled flotation mattress or bladder M arranged within the frame and supported atop the platform P.

The frame F includes a pair of like elongate side wall sections or units S each of which is related to one outer side portion of the platform P and includes a pair of like elongate end wall sections or units S' each related to one outer end portion of the platform P.

The frame F next includes an elongate anchor plate A for each of the wall units S and S'. Each of the anchor plates A is suitably securely fixed to the top of the outer portion of the platform with which its related wall unit is related.

In practice the anchor plates A are elongate plate-like parts with top and bottom surfaces 20 and 21 and inside and outside edges 22 and 23. Though the plates A can be made of any suitable material, it is preferred that they be extruded of a suitable long chain polyester resin or plastic material.

The plates A can be nailed, tacked, stapled and/or cemented to the platform, as desired or as circumstances require. In one preferred carrying out of the invention, they are screw fastened atop the platform, as shown.

Next, the frame structure includes coupling means C that releasably hingedly secure each of the wall units S and S' to their related anchor plates A. Each means C includes an elongate female coupling part D on its related anchor plate A and an elongate male coupling part E on the wall section S or S' that is related to that anchor plate.

The female coupling part D of each coupling means C consists of an elongate spline receiving channel 40 with a narrow web receiving access slot 41 and with open ends 42. The part D can be fixed to and carried by, but is preferably formed integrally with the plate A, as shown.

The male part E of the coupling means C includes an elongate, flexible, ribbon-like web 43 with inner and outer edges or edge portions and an elongate spline 46 extending longitudinally of the outer edge of the web.

The inner edge of the web is fixed to and extends longitudinally of its related wall unit, as shown.

The spline 46 of each coupling means C is slidably engaged in and longitudinally through the channel 40 of a related female coupling part D, from either open end of the part D and is such that it cannot be moved laterally through the slot 41 of the part D. The web 43 of the coupling means D is slidably engaged through the longitudinal slot 41 of its related part D, from either end thereof.

With the means C illustrated and described above, it will be apparent that upon arranging a related anchor plate A and wall unit S (S') in end-to-end relationship, with the web 43 and spline 46 of the male coupling part D aligned with the slot 41 and channel 40 of the coupling part E, the wall unit can be moved longitudinally of the anchor plate to move the web and spline of part D longitudinally into full engagement within the slot and channel of part E, securely hingedly securing the wall unit and plate together.

It will also be apparent that the wall sections for units and plates can be disengaged by simple reversal of the above procedure.

Figure 8:
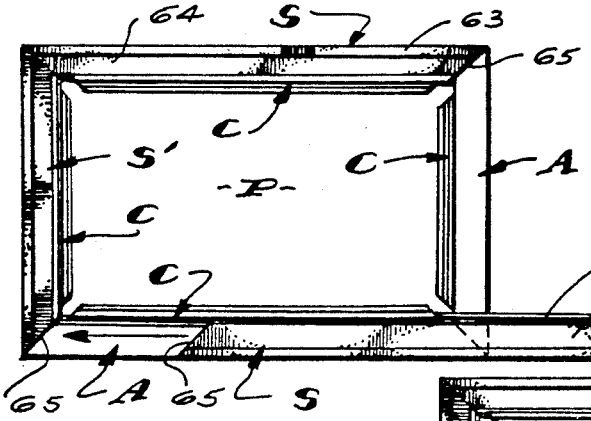
FIGS. 8 and 9 are diagrammatic views showing parts of the structure in different partially assembled positions.
Figure 9:
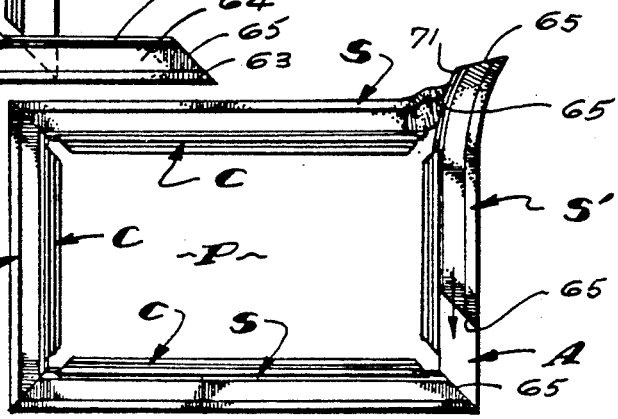

As diagrammatically illustrated and as best seen in FIGS. 8 and 9 of the drawings, the male coupling parts D of the first three wall units to be assembled can be easily and conveniently slidably engaged within their related female coupling parts E of their related anchor plates without interference with and between the several wall units. Installation of the last or fourth-to-be-installed wall unit will however be interfered with by the end portion of the previously installed wall unit that occurs adjacent the end of the anchor plate with which the fourth wall unit is arranged to enter and advance the coupling part E of the last-to-be-installed wall section into its related coupling plate D. In accordance with the above and to enable installation of the fourth or last-to-be-installed wall unit, the end portions of the coupling parts D can be relieved or shortened, as shown, so that the ends of those parts do not abut or overly each other; and, the spline 46 of at least the last-to-be-installed wall unit is made flexible and such that that unit can be easily and conveniently bent or flexed substantially as illustrated in FIG. 9 of the drawings to effect easy installation thereof.

In furtherance of the above and as shown in FIG. 4 of the drawings, the spline 46 can be advantageously extruded of a suitable soft flexible plastic material in the form of a tube and having a sufficiently thick wall to prevent its displacement through the slot 46 of a related female coupling part D, yet sufficiently flexible to allow for easy bending, as required.

It is to be noted that the splines related to three of the wall sections need not be flexible and could, for example, be made of coiled wire, wood doweling, as shown in FIG. 5, or the like.

Splines of coiled stainless wire have proven to be particularly suited for use in this invention, but have proven to be excessively costly.

Figure 10:
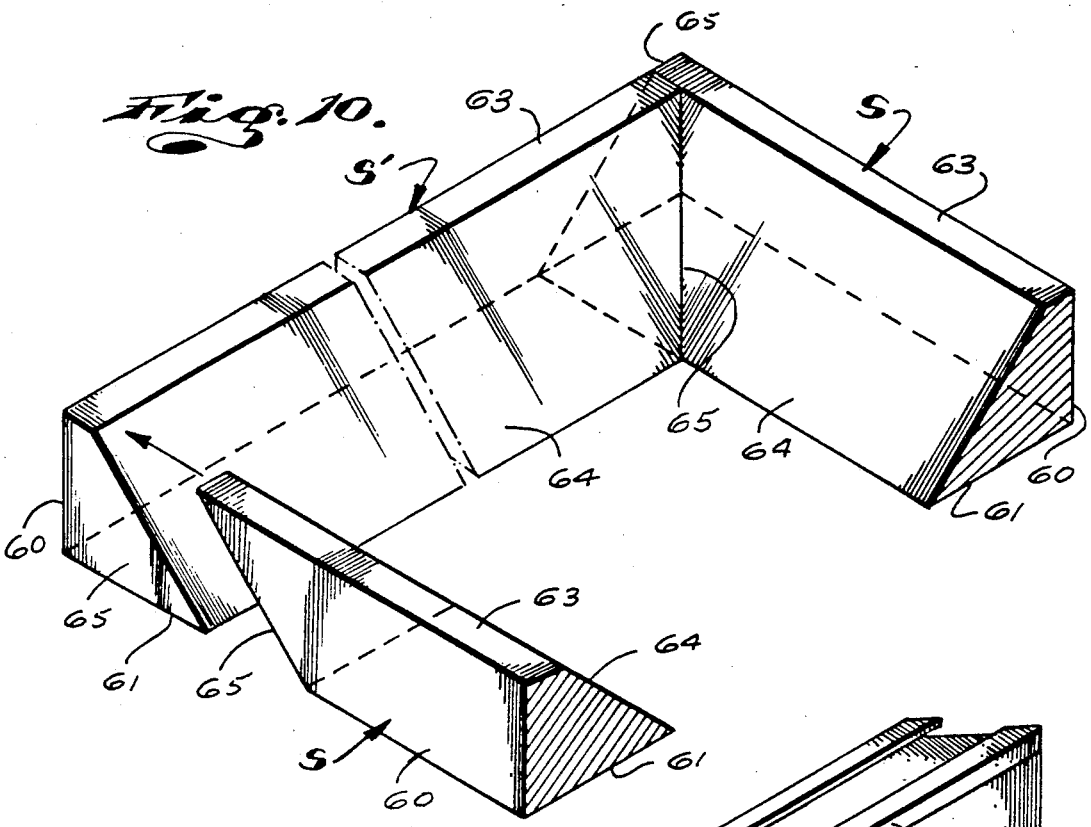
FIG. 10 is an isometric view of a modified form of wall units.
Figure 11:
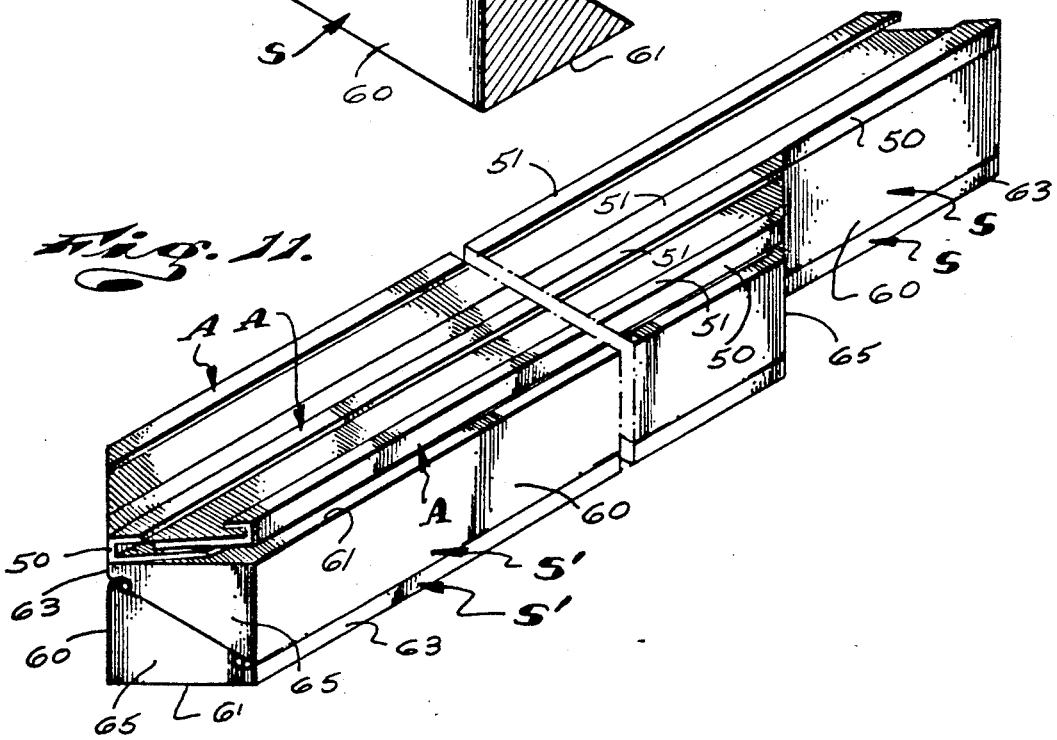
FIG. 11 is an isometric view of the wall units and anchor plates for a frame assembled preparatory to being packaged for shipment and storage.

In practice, the wall sections or units S and S' can be formed so that their related ends butt each other in a manner such as is shown in FIGS. 1, 8 and 9 of the drawings or can, if desired, be formed and made to butt one another as diagrammatically shown in FIGS. 10 and 11 of the drawings.

In the preferred carrying out of the invention, the female coupling parts D are positioned and extend longitudinally of the inside edge or edge portion 22 of their related anchor plate A. They are formed so that the slots 41 thereof are above the top surface 20 of the plates and open outwardly and upwardly. The outer edges of the flexible webs 43 of the male coupling parts are secured to the lower inside corner edges of their related wall sections or units that occurs slightly outward from the inner edges of the plates A and the coupling parts D, as clearly shown in FIGS. 2 and 3 of the drawings. With this relationship of parts the inner lower edges of the wall sections are pivotally connected with their related anchor plates and the wall sections can be pivoted to swing upwardly and inwardly, as shown in dotted lines in FIG. 2 of the drawings. Such pivoting of the wall sections enables bedding, such as sheets and blankets, to be neatly tucked between the plates A about the outer perimeter portions of the platform and the wall sections of the frame.

In the preferred carrying out of the invention and as shown in the drawings, the outer edges of the anchor plates A are formed with longitudinally extending downwardly projecting flanges 50 that occur outward of and overly the outer edges of the platform P to suitable shield and obscure the edges of the platform and effectively dress the outer perimeter of the frame structure. Thus the edges of the platform need not be cut cleanly and accurately and need not be otherwise finished. In practice, should the platform be made slightly undersized or the like, the outer edge portions of the anchor plates A can be made to project out from the edges of the platform P a noticeable distance without adverse effects.

Still further, and as illustrated, the flanges 50 on the plates A can be and are preferably formed with inwardly projecting lips 51 along their lower edges. The lips 51 project inwardly below and slidably engage the lower surface 11 of the platform to effectively hide any gap or space that might occur between the platform and the flanges 50 and prevent the outer portions of the plates from being bent or otherwise moved upwardly and out of position relative to the platform should feet. brooms, vacuum cleaners and the like be forcibly urged between the floor or deck and the outer edges of the platform.

But for length, the wall sections S and S' are alike. In the preferred form of the invention, each wall section includes an elongate core 60 of soft resilient foam plastic cut from a slab or block of foam plastic. The core 60 has a flat longitudinally extending horizontal downwardly disposed bottom surface 61 that is substantially dimensionally similar to and overlies a related anchor plate A; a flat longitudinally extending, vertical, outwardly disposed outside surface 62; a flat longitudinally extending, upwardly disposed top surface 63; a flat, longitudinally extending inwardly and downwardly inclined, inwardly and upwardly disposed inside surface 64; and flat vertical substantially longitudinally outwardly and inwardly disposed mitered end surfaces 65.

In addition to the above-noted core 60, each of the wall sections or units includes a thin, flexible, jacket or envelope 66 of durable sheet material that is formed to closely engage all of the surfaces of the core and to define bottom, outside, top, inner and end walls or wall portions that correspond to the surfaces 61, 62, 63, 64 and 65 of the core and to which those reference numbers are also directed in the drawings for identification purposes.

The mitered ends 65 of the core and envelope of each wall section S establishes flat opposing pressure engagement with the ends 65 of the cores and envelopes at their related wall sections S', as clearly shown in th drawings.

The shape in which the material for the envelopes is cut and the manner in which the material is stitched or otherwise bound together preferably establishes a longitudinal stitched seam 70 along the lower inside edge of each wall section or unit, where the web 43 of a related male part of the coupling means C is attached.

In the form of the invention shown, the web 43 of the part D of the means C is established of an elongate strip of flexible sheet material of fabric folded and stitched longitudinally to define a tubular sleeve 71 along its inner edge and in which its related spline 46 is securely or snugly engaged. Two layers of the web material are shown extending outward from the sleeve 70 and are suitably incorporated and stitched into and with the seam 70 in accordance with common and good practices.

The waterbed mattress M is shown comprising a single bladder that is rectangular in planned configuration. The bladder of the mattress M is made of a suitable soft, supple and pliable water-impervious sheet material, such as polyvinylchloride, and when in use in the bed B, has or defines a bottom wall 80 that establishes flat supported engagement atop the platform P, outwardly and upwardly inclined side and end walls 81 that establish flat bearing engagement with and are supported by the inside surfaces 64 of the wall sections or units and a horizontal, body or user supporting top wall 83. The bladder is provided with a suitable filler fitting (not shown) to facilitate filling the bladder with water or the like and to facilitate draining the bladder of water or the like should circumstances require. Such fittings are so well known to those skilled in the art that they need not be illustrated and described.

The mattress is of such potential volumetric extent so that when it is filled with a sufficient volume of water to lift the top wall 83 near to the plane of the top surfaces 63 of the wall sections, its top wall is left with sufficient slack so that it can be displaced downwardly into the water and can conform to a user's body when the user lies atop the mattress.

The several wall sections of the frame F support and prevent outward displacement of the side and end walls of the bladder, so that it is maintained in a proper operating configuration at all times.

In practice, the above-noted single bladder can be replaced by a plurality of elongated tubular bladders arranged atop the platform P and within the frame F in adjacent side-by-side relationship, without in any way affecting or departing from the broader aspects and spirit of the invention.

In some cases, as when the vertical height of the wall sections is great, there might be a tendency for the upper portions of the adajcent ends of the wall sections to separate or spread apart when subject to the loads imposed upon the frame by the water-filled bladder. In such cases, fabric tabs (not shown) with lacing eyelets can be stitched to the outer ends of the envelope, at the ends of the sections, and laces can be engaged through the eyelets, be drawn and tied to prevent displacement of the end sections. Numerous other means suitable for achieving the same end results exist and might be employed.

It will be apparent that when the waterbed structure is in use and a user moves into engagement with a side edge portion of the bed defined by the frame structure, the frame structure will readily yield to the weight of the user and is such that it does not create a troublesome or discomforting obstruction or obstacle.

It will be noted that the configuration of the cores and envelopes of the wall units and the manner in which the weight of the water within the bladder is directed onto them is such that turning, stretching and/or twisting of the cores within the envelopes is highly unlikely to occur. Further, should a core become twisted or displaced within its envelope or should a wall section be otherwise damaged and need to be repaired or replaced, it is an easy-to-perform task to remove such a wall section, manually reposition the core thereof or repair the section and thereupon reinstall it. Alternatively, a replacement section might be installed in its place. In any event, the great inconvenience and cost of substantial reconstruction of the bed frame, or replacement of it with a new frame, should one section thereof need repair or replacement, is easily avoidable.

Finally, following manufacture of the wall sections or units and the anchor plates of the waterbed frame structure, those parts can be assembled and stacked together as shown in FIG. 11 of the drawings and thereafter tied together or suitable wrapped for storage and, transportation and the like, preparatory to being assembled at a site of use. The ease and convenience of handling the noted parts in disassembled packaged condition is far greater than handling them in assembled condition. Still further, the space required to store and the cost of transporting the noted parts when in the above-noted disassembled and packaged condition is a small fraction of the space required and the cost to transport those same parts in assembled condition, with a related platform P.

It has been determined that the cost of producing and packaging, plus the cost of the plywood required to make a platform and the cost of shipping and handling the above-noted stacked and packaged parts by common carrier from one shipping zone to another is less than the cost of making and packaging a fully assembled soft-sided bed frame structure at a factory site. Further, the space required to store the noted packaged parts, including the platform, is a small fraction of the space required to store fully assembled, comparable, waterbed frame structures (at both factory and retail outlet sites).

It has also been determined that one ordinary professional waterbed installer, when once familiar with the invention, can move the several frame parts to an installation site more easily and quickly than two men can move a fully assembled waterbed frame to such a site; and can assemble the parts, preparatory to installing a mattress, in less than 30 minutes. Accordingly, any added costs incurred when assembling the new bed frame structure here provided is more than offset by, for example, savings in the costs for shipping and/or the costs for storing the parts of the frame structure as they move through commerce.

Having described only one typical preferred form and embodiment of the invention, I do not wish to be limited to the specific details herein set forth but wish to reserve to myself any modifications and/or variations that might appear to those who are skilled in the art and that fall within the scope of the following claims.

Having described my invention, I claim:

1. A soft-sided frame for a flotation mattress comprising a flat horizontal rectilinear platform with top and bottom surfaces and side and end edges, anchor plates secured to the top surface of the platform about the side and end portions thereof; elongate wall sections of soft flexible and resilient material overlying the side and end portions of the platform to project upwardly therefrom and extend about the outer perimeter thereof; and, interengaged coupling parts on the anchor plates and the wall sections releasably securing the wall sections to the platform, the platform and wall sections defining an upwardly opening frame structure to receive and support the bottom and sides of a slack-filled waterbed flotation mattress.

2. A soft-sided frame set forth in claim 1 wherein; one of said coupling parts is a female coupling part with an elongated spline receiving channel with open ends and an elongate web receiving access slot coextensive with and communicating with the channel; another of the coupling parts is a male part with an elongate spline slidable longitudinally into and out of captive engagement in the channel of the female coupling part and an elongate web carrying the spline and slidable longitudinally into and out of the slot of the male coupling part, the male and female parts are moved into and out of engagement with each other upon movement of the wall sections longitudinally of their related edge portions of the platform.

3. The soft-sided frame set forth in claim 2 wherein; the female coupling parts are on the anchor plates and the webs of the male coupling parts are fixed to the wall sections.

4. The soft-sided frame set forth in claim 1 wherein; the wall sections are elongate units each including a core of soft flexible and resilient foam plastic material and an exterior envelope of flexible durable sheet material, said core and envelope are formed to define a horizontal downwardly disposed bottom surface, a vertical outwardly disposed outside surface, a horizontal upwardly disposed top surface, a substantially inwardly disposed inside surface and substantially longitudinally outwardly disposed end surfaces.

5. The soft-sided frame set forth in claim 4 wherein; one of said coupling parts is a female coupling part with an elongate spline receiving channel with open ends and an elongate web receiving access slot coextensive with and communicating with the channel; another coupling part is a male part with an elongate spline slidable longitudinally into and out of captive engagement in the channel of the female coupling part and an elongate web carrying the spline and slidable longitudinally into and out of the slot of the male coupling part, the male and female parts are moved into and out of engagement with each other upon movement of the wall sections longitudinally of their related edge portions of the platform.

6. The soft-sided frame set forth in claim 5 wherein; the female coupling parts are on the anchor plate and the webs of the male coupling parts are parts extending from the splines to the envelopes of their related wall sections to which they are fixed.

7. The soft-sided frame set forth in claim 5 wherein; the female coupling parts are on the anchor plate; the webs of the male coupling parts are flexible parts that extend from the splines to the lower inside corners of the envelopes of their related wall sections at the junctions of the bottom and inside surfaces thereof and to which they are fixed, said coupling parts hingedly secure the lower inside corners of the wall sections to the platform and allow for upward in and inward pivotal movement of the wall sections relative to their related edge portions of the platform to define outwardly opening spaces between the wall sections and the platform to accommodate related bedding.

8. The soft-sided frame set forth in claim 1 wherein; the anchor plate related to each side and end edge portion of the platform is an elongate flat plate with inside and outside edges and top and bottom surfaces and is substantially coextensive with, overlies and is secured to a related edge portion of the platform; each wall section is an elongate unit that is substantially coextensive with and overlies a related side portion of the platform and includes a core of soft flexible resilient foam plastic material and an outer exterior envelope of flexible durable sheet material, the core and envelope of each wall section are formed to define a vertical outwardly disposed outside surface, a horizontal upwardly disposed top surface, a substantially inwardly disposed inside surface, substantially longitudinally outwardly disposed end surfaces and a downwardly disposed bottom surface that overlies and opposes the anchor plate secured to its related edge portion of the platform, the engageable coupling parts on the anchor plates and wall sections are at the inside edge portions of the anchor plates and at the lower inside corner edges of the wall sections defined by the inside and bottom surfaces thereof.

9. The soft-sided frame set forth in claim 8 wherein; the coupling part on each anchor plate is a female coupling part that defines a longitudinally extending spline receiving channel with at least one open end and an elongate substantially outwardly and upwardly opening web receiving slot communicating with the channel, the coupling part on each wall section is a male coupling part and includes an elongate spline slidably engaged into the channel of a related female coupling part and releasably held captive therein and an elongate flexible web extending from the spline through the access slot of its related female coupling part to the lower inside corner of its related wall section.

10. The soft-sided frame set forth in claim 9 wherein; surfaces at the ends of the side wall sections related to the side edge portions of the platform and related surfaces at the ends of the end wall sections related to the end edge portions of the platform are in opposing engagement with each other.

11. The soft-sided frame set forth in claim 8 wherein; the coupling part on each anchor plate is a female coupling part that defines a longitudinally extending spline receiving channel with at least one open end and an elongate substantially outwardly and upwardly opening web receiving slot communicating with the channel, the coupling part on each wall section is a male coupling part and includes an elongate spline slidably engaged into the channel of a related female coupling part and releasably held captive therein and an elongate flexible web extending from the spline through the access slot of its related female coupling part to the lower inside corner of its related wall section, the end surfaces of each wall section are disposed longitudinally outwardly and inwardly at a mitered angle and each establishes flat bearing engagement on an opposing end surface of an adjacent related wall section.

12. The soft-sided frame set forth in claim 8 wherein; the outside edge of each anchor plate occurs outward from its related side edge of the platform and is formed with a longitudinally extending depending wall that overlies and shields its related outer edge of the platform.

13. The soft-sided frame set forth in claim 12 wherein; the coupling part on each anchor plate is a female coupling part that defines a longitudinally extending spline receiving channel with at least one open end and an elongate substantially outwardly and upwardly opening web receiving slot communicating with the channel, the coupling part on each wall section is a male coupling part and includes an elongate spline slidably engaged into the channel of a related female coupling part and releasably held captive therein and an elongate flexible web extending from the spline through the access slot of its related female coupling part to the lower inside corner of its related wall section.

14. The soft-sided frame set forth in claim 12 wherein; surfaces at the ends of the wall sections related to the side edge portions of the platform and related surfaces at the ends of the wall sections related to the end edge portions of the platform are in firm butted opposing engagement with each other.

15. The soft-sided frame set forth in claim 12 wherein; the coupling part on each anchor plate is a female coupling part that defines a longitudinally extending spline receiving channel with at least one open end and an elongate substantially outwardly and upwardly opening web receiving slot communicating with the channel, the coupling part on each wall section is a male coupling part and includes an elongate spline slidably engaged into the channel of a related female coupling part and releasably held captive therein and an elongate flexible web extending from the spline through the access slot of its related female coupling part to the lower inside corner of its related wall section, the end surfaces of each wall section are disposed longitudinally outwardly and inwardly at a mitered angle and each establishes flat bearing engagement on an opposing end surface of an adjacent related wall section.

16. The soft-sided frame set forth in claim 8 wherein; the outer side edge of each anchor plate occurs outward from its related side edge of the platform and is formed with a longitudinally extending depending and thence inwardly projecting wall that extends about and embraces its related outer edge portion of the platform.

17. The soft-sided frame set forth in claim 16 wherein; the coupling part on each anchor plate is a female coupling part that defines a longitudinally extending spline receiving channel with at least one open end and an elongate substantially outwardly and upwardly opening web receiving slot communicating with the channel, the coupling part on each wall section is a male coupling part and includes an elongate spline slidably engaged into the channel of a related female coupling part and releasably held captive therein and an elongate flexible web extending from the spline through the access slot of its related female coupling part to the lower inside corner of its related wall section.

18. The soft-sided frame set forth in claim 16 wherein; surfaces at the ends of the wall sections related to the side edge portions of the platform and related surfaces at the ends of the wall sections related to the end edge portions of the platform are in opposing engagement with each other.

* * * * *